US007717045B2

(12) United States Patent
Robinson

(10) Patent No.: US 7,717,045 B2
(45) Date of Patent: May 18, 2010

(54) FOLDING TABLE

(76) Inventor: Dean Robinson, 6 Pawtucket Ave., Bristol, RI (US) 02809

( * ) Notice: Subject to any disclaimer, the term of this patent is extended or adjusted under 35 U.S.C. 154(b) by 190 days.

(21) Appl. No.: 11/745,247

(22) Filed: May 7, 2007

(65) Prior Publication Data

US 2007/0256610 A1 Nov. 8, 2007

Related U.S. Application Data

(60) Provisional application No. 60/746,671, filed on May 8, 2006.

(51) Int. Cl.
*A47B 3/00* (2006.01)

(52) U.S. Cl. ..... 108/115

(58) Field of Classification Search ..... 108/115, 108/165–167, 169, 171, 173, 174, 176; 248/116, 248/436, 440.1; 403/329, 353; 297/16.1, 297/46, 51, 440.12; 211/195, 149, 126.6
See application file for complete search history.

(56) References Cited

U.S. PATENT DOCUMENTS

| | | | | | |
|---|---|---|---|---|---|
| 1,625,294 | A | | 4/1927 | Whitesides | |
| 2,550,959 | A | * | 5/1951 | Bowman | 108/115 |
| 3,188,158 | A | * | 6/1965 | Sanchez | 312/277 |
| 3,656,439 | A | | 4/1972 | Domin | |
| 3,994,527 | A | | 11/1976 | Nikitits et al. | |
| 4,303,018 | A | * | 12/1981 | Lehmann | 108/12 |
| 4,630,861 | A | * | 12/1986 | Henschel | 297/44 |
| 4,662,515 | A | * | 5/1987 | Newby, Sr. | 206/349 |
| D293,862 | S | * | 1/1988 | Hubert | D6/430 |
| 4,809,619 | A | * | 3/1989 | Piretti | 108/115 |
| 5,052,308 | A | * | 10/1991 | Brown | 108/118 |
| D353,280 | S | | 12/1994 | Westerburgen | |
| 5,382,087 | A | * | 1/1995 | Pouch | 312/140.2 |
| 5,445,085 | A | * | 8/1995 | Westerburgen | 108/115 |
| 5,463,945 | A | | 11/1995 | Kendall | |
| 5,501,158 | A | | 3/1996 | Cheney | |
| 5,562,050 | A | * | 10/1996 | Colquhoun | 108/115 |
| 5,882,098 | A | * | 3/1999 | Brown et al. | 312/258 |

(Continued)

FOREIGN PATENT DOCUMENTS

| | | |
|---|---|---|
| DE | 4219875 | 12/1993 |

*Primary Examiner*—Janet M Wilkens
*Assistant Examiner*—Dan Rohrhoff
(74) *Attorney, Agent, or Firm*—Barlow, Josephs & Holmes, Ltd.

(57) ABSTRACT

A folding table is disclosed. The folding table includes two top panels hingedly connected together to form a table top having a top surface and a bottom surface. The table top has a folding action about the hinged connection of the two top panels. Four leg panels depend from the bottom surface of the table top. Each of the leg panels has a first section and a second section. The first section has a top edge hingedly connected to the bottom surface of the table top and a side edge hingedly connected to the second section. The leg panels are arranged in two pairs of leg panels wherein the second section of each thin leg panel in the respective pair is hingedly connected to the other resulting in a stiff leg member. The hinged action of the two interconnected second panels fall in a plane of symmetry with the folding action of the table top whereby the folding table may be collapsed from a deployed state forming a table to a folded state for storage and portability.

5 Claims, 6 Drawing Sheets

U.S. PATENT DOCUMENTS

| | | | | |
|---|---|---|---|---|
| 6,161,901 | A | 12/2000 | Avner | |
| 6,257,153 | B1 * | 7/2001 | Portugal | 108/115 |
| 6,314,892 | B1 | 11/2001 | Favini | |
| 6,513,443 | B2 | 2/2003 | Todd | |
| 6,598,543 | B1 * | 7/2003 | Ellsworth et al. | 108/115 |
| 6,779,466 | B2 * | 8/2004 | Shabram, Jr. | 108/35 |
| 6,851,564 | B2 | 2/2005 | Ng | |
| 7,096,797 | B2 | 8/2006 | Sharpe et al. | |
| D531,429 | S * | 11/2006 | Henschel | D6/480 |
| 7,174,838 | B2 * | 2/2007 | Sagol et al. | 108/169 |
| 7,299,753 | B2 * | 11/2007 | Strong | 108/115 |
| 2002/0162488 | A1 | 11/2002 | Holub et al. | |
| 2005/0284790 | A1 | 12/2005 | Gordils | |

* cited by examiner 10
12A
12B
18
18
10
70
18
18A
18B
18A
18B
18

10
70
70
12A
12B
12
18B
18
18B
18
18A
18
18A
18

FOLDING TABLE

CROSS-REFERENCE TO RELATED APPLICATION

This application claims priority to earlier filed U.S. Provisional Patent Application Ser. No. 60/746,671, filed May 8, 2006, the contents of which are incorporated herein by reference.

BACKGROUND OF THE INVENTION

1. Field of the Invention

The present invention relates generally to furniture and more particularly to a folding table that may be folded flat for convenient storage and portability.

2. Background of the Related Art

Folding tables are well-known in the art and come in a variety of configurations. The primary advantage of a folding table is its ability to be folded into a compact form and stored when not in use. Folding tables generally have a tabletop and two or more, usually four, depending legs. The legs are hingedly connected to the tabletop and can fold underneath the table to be easily store. However, folding tables, even when collapsed, are often still bulky. It is, therefore, desirable to make a folding table that has the smallest possible dimensions when folded and, as a consequence, new designs that minimize the "folded" dimensions of the folding table are highly desired. Therefore, there is a need for a folding table that has small dimensions when folded.

Moreover, Folding tables can be difficult to deploy and stow and can even sometimes injure the person folding the table by pinching his or her fingers within the hinged portions of the table. Therefore, there is a need for a folding table that is easy to use and minimizes the potential chances of injury to the user.

SUMMARY OF THE INVENTION

The folding table of the present invention solves the problems of the prior art by providing a new unique folding table design that has a width of no thicker than twice the cross-section width of the tabletop and legs when folded. Moreover, the folding table of the present invention transforms from the folded state to the deployed state in one simple movement and is nearly self-erecting. The fact that the folding mechanisms are initiated by one simple movement has the added advantage of making it difficult for an individual to pinch his or her fingers while deploying or stowing the table.

In particular, the folding table includes two top panels hingedly connected together to form a table top having a top surface and a bottom surface. The table top has a folding action about the hinged connection of the two top panels. Four leg panels depend from the bottom surface of the table top. Each of the leg panels has a first section and a second section. The first section has a top edge hingedly connected to the bottom surface of the table top and a side edge hingedly connected to the second section. The leg panels are arranged in two pairs of leg panels wherein the second section of each leg panel in the respective pair is hingedly connected to the other thereby creating stiff leg section when deployed. The hinged action of the two interconnected second panels fall in a plane of symmetry with the folding action of the table top whereby the folding table may be collapsed from a deployed state forming a table to a folded state for storage.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figures 1, 2, 3:
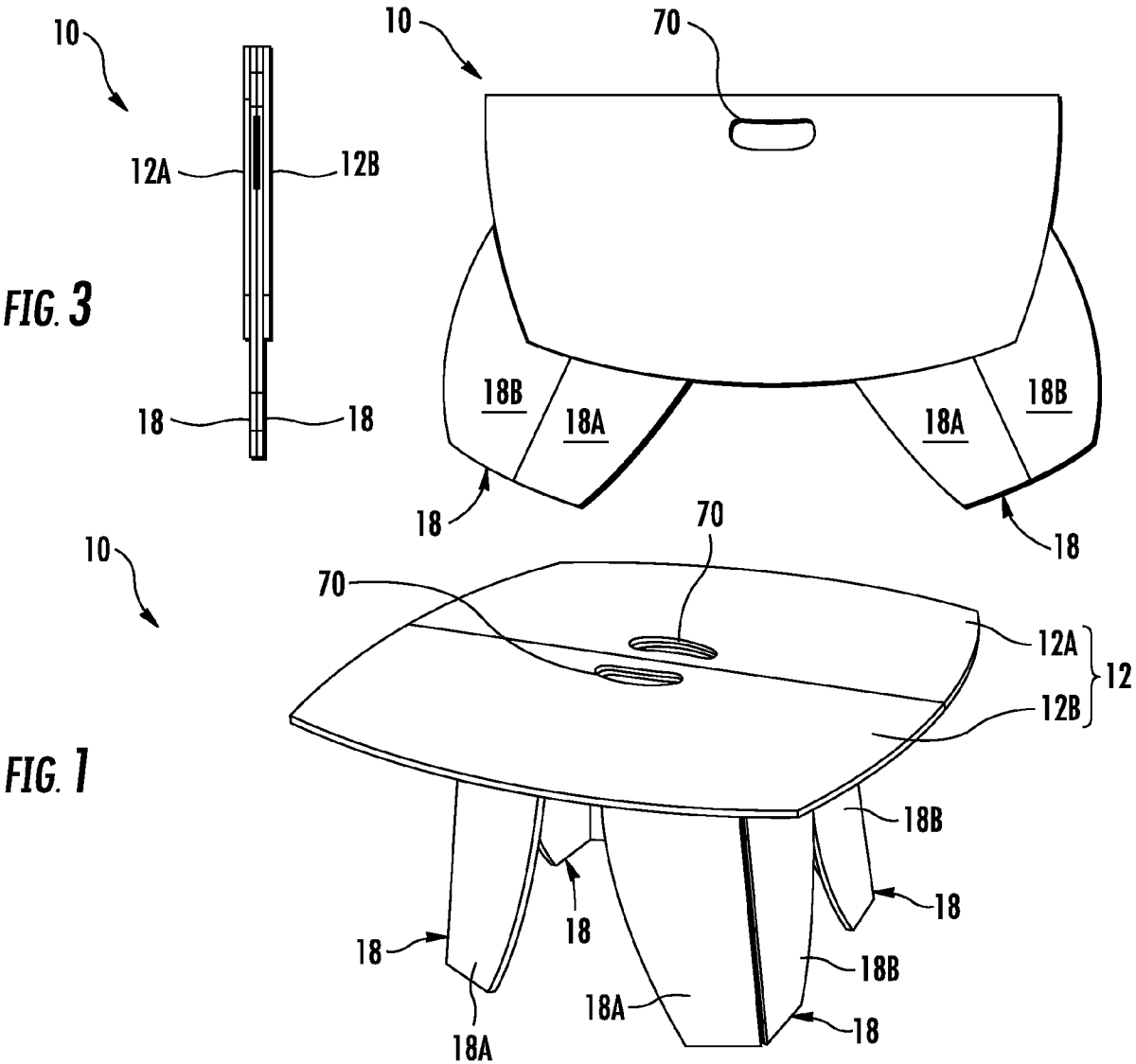
FIG. 1 is a top perspective view of an embodiment of the folding table of the present invention.
FIG. 2 is a side view of the embodiment of the folding table of FIG. 1 in its folded state.
FIG. 3 is an edge side view of the embodiment of the folding table of FIG. 1 in its folded state.

Referring to FIGS. 1-3, the folding table of the present invention is shown generally at 10. In particular, the folding table includes two top panels 12*a*, 12*b*, which are hingedly connected together to form a tabletop 12, and four folding leg members 18. As will be described in greater detail below, the top panels 12*a*, 12*b*, and four folding leg members 18 are configured to allow the folding table 10 to be reconfigured between a folded state (FIGS. 2 and 3) and a deployed state (FIG. 1). In the deployed state, the four leg members 18 support the tabletop 12 in an upright position, and in the folded state, the four leg members 18 fold discreetly between the two top panels 12*a*, 12*b* for convenient storage and portability of the folding table 10.

Figure 4:
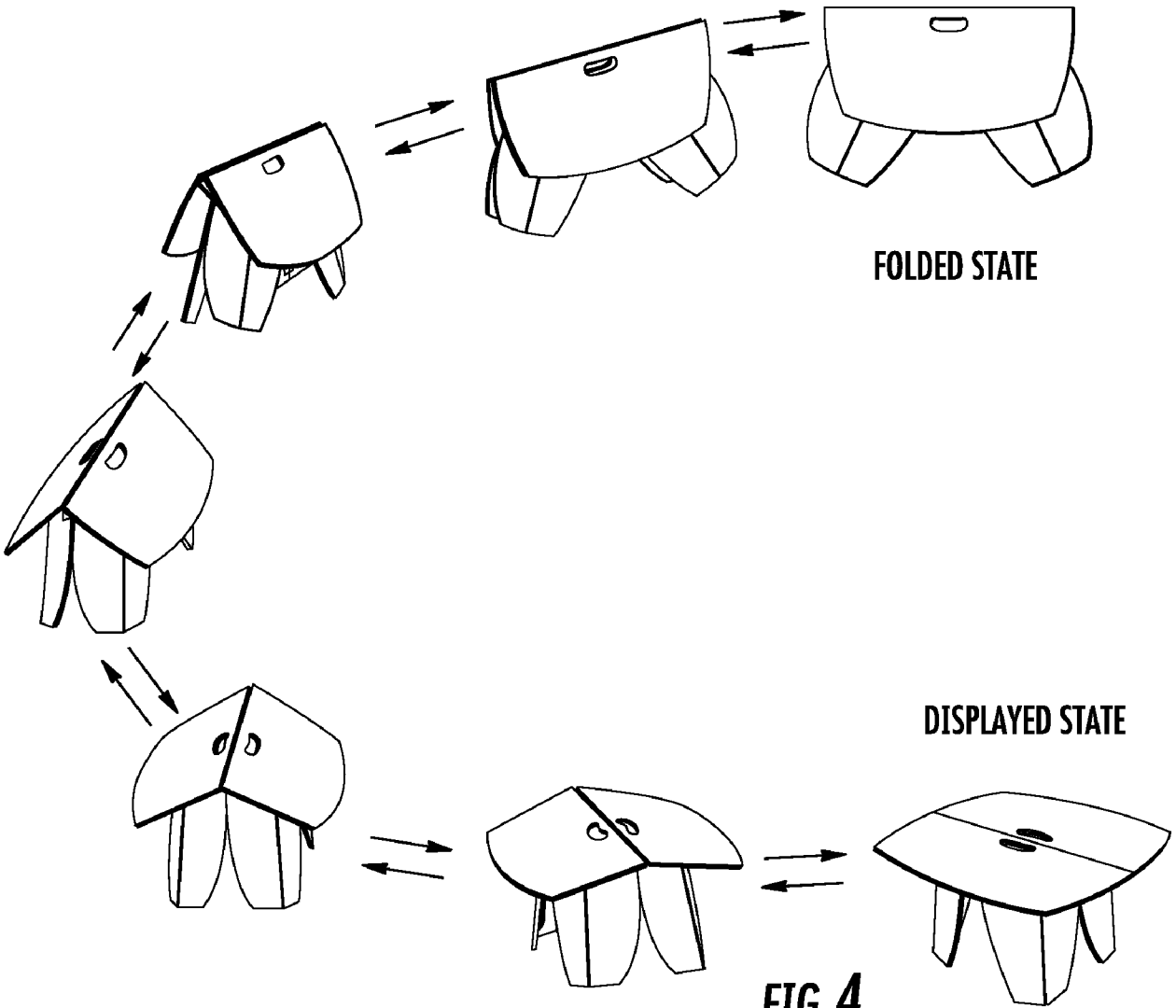
FIG. 4 is a pictorial flow chart of the steps of transforming the folding table from its folded state to its deployed or unfolded state.
Figure 5:
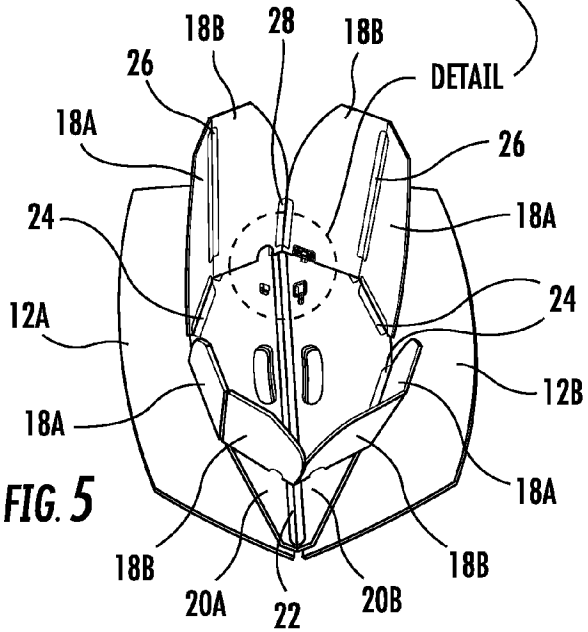
FIG. 5 is a bottom perspective view of the embodiment of the folding table.
Figure 8B:
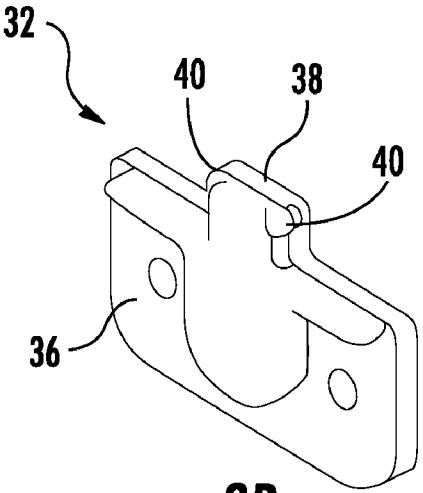
FIG. 8*b* is a rear perspective view of the barb.
Figure 8A:
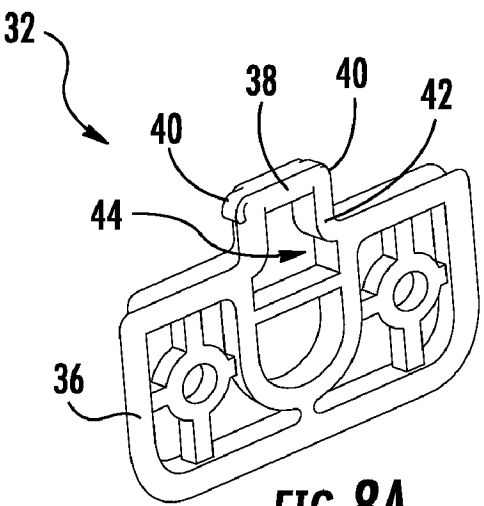
FIG. 8*a* is a front perspective view of the barb.
Figure 9A:
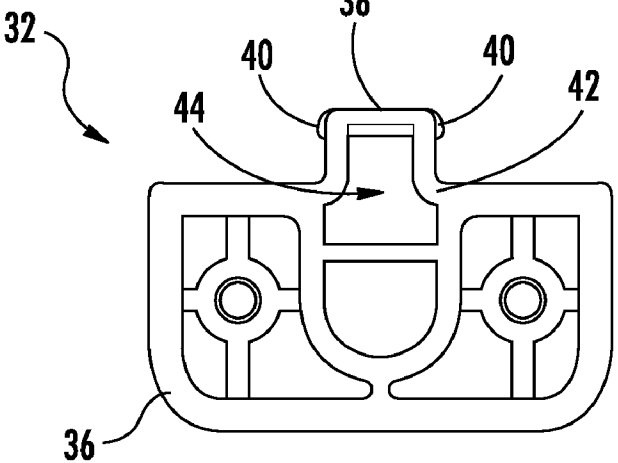
FIG. 9*a* is a top plan view of the barb.
Figure 9B:
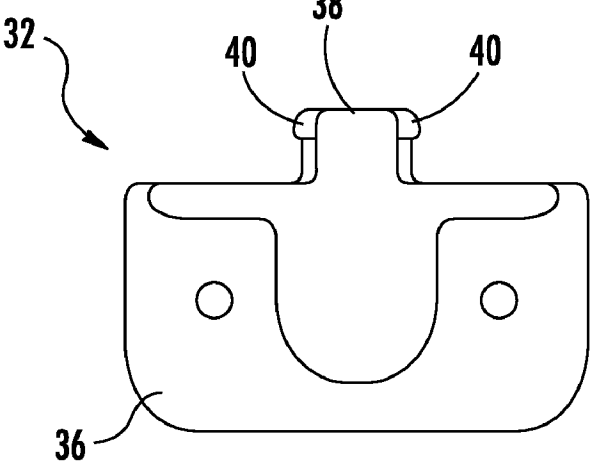
FIG. 9*b* is a bottom plan view of the barb.
Figure 10A:
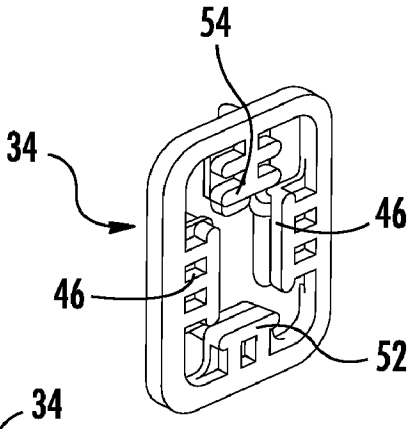
FIG. 10*a* is a top perspective view of the catch.
Figure 10B:
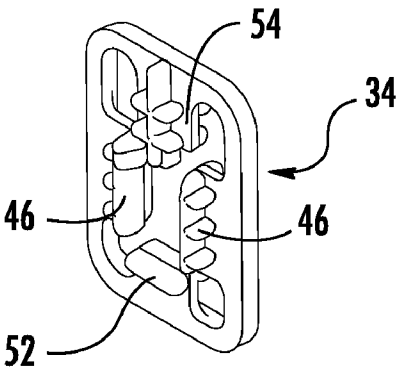
FIG. 10*b* is a bottom perspective view of the catch.
Figure 11A:
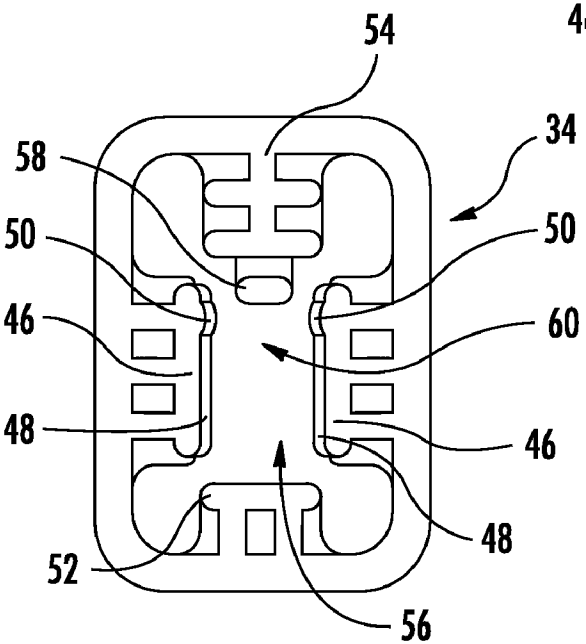
FIG. 11*a* is a top plan view of the catch.
Figure 12:
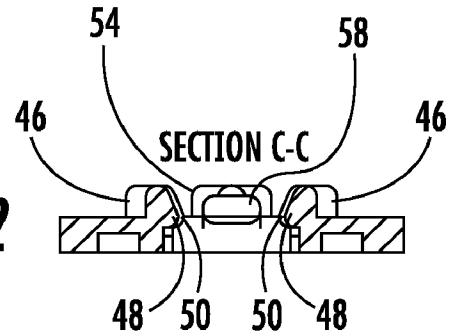
FIG. 12 is a cross-section view of the catch through line C-C of FIG. 10*a;*
Figure 11B:
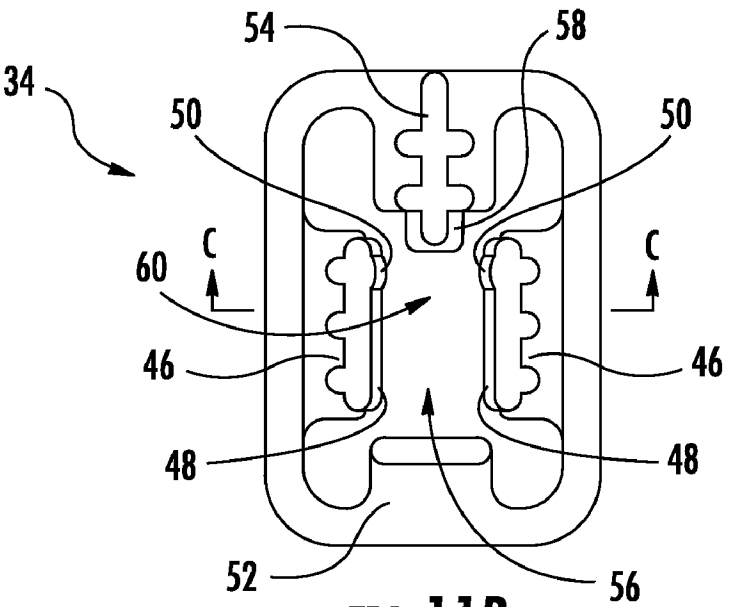
FIG. 11*b* is a bottom plan view of the catch.

The folding table 10 of the present invention is constructed of twelve thin panels, which can be fashioned from a variety of materials, such as plywood, plastic, metal etc. In particular, there are two top panels 12*a*, 12*b*, two backing panels 20*a*, 20*b* (best seen in FIG. 5), four side-leg panels 18*a* and four end-leg panels 18*b*. The panels 12*a*, 12*b*, 18*a*, 18*b* are connected together by eleven hinges (best seen in FIG. 5) so that the assembly can transform in one smooth motion with all hinges active between a folded state nesting all panel surfaces parallel, and a deployed state with four leg members 18 rigidly supporting an elevated tabletop surface 12. The folding action of the folding table 10 is best illustrated in FIG. 4.

The two top panels 12*a*, 12*b* are connected to and cantilever beyond the two backing panels 20*a*, 20*b*, respectively. Each top panel 12*a*, 12*b* and backing panel 20*a*, 20*b* set is connected together by a hinge 22 that lies in a plane of symmetry about which all folding action is symmetrical. To each backing panel 20*a*, 20*b*, two side-leg panels 18*a* are connected with hinges 24 along backing panel edges 20*a*, 20*b* that lie at a distance from and at small angles with the hinge 22 connecting the backing panels 20*a*, 20*b*. This small angle between the backing panel hinge 24 and backing panel hinge 22 prevents racking of the folding table 10 in its deployed state.

To each side-leg panel 18*a*, a hinge 26 connects an end-leg panel 18*b* so that when deployed a sufficient angle between the plane of the side-leg panel 18*a* and the plane of the end-leg panel 18*b* results in a stiff and rigid leg member 18. The two end-leg panels 18*b* are connected together by a hinge 28 that acts in the plane of symmetry established by the backing panel hinge 22. The shape of the end-leg panel 18*b* is such that when deployed, one edge 30 serves to support the tabletop surface 12.

Figure 7:
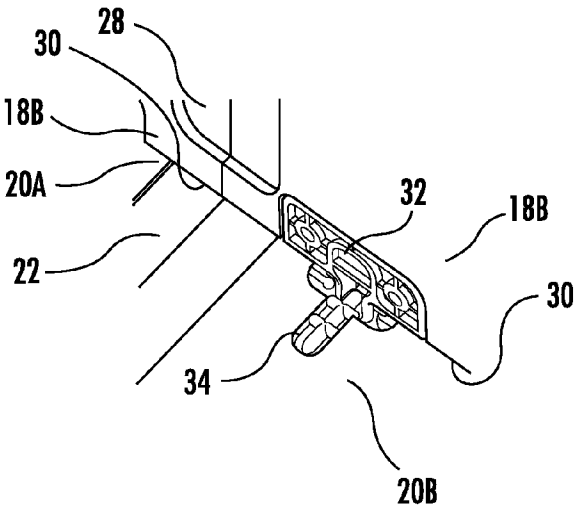
FIG. 7 is a close up view of the latch engaged in locked position.
Figure 6:
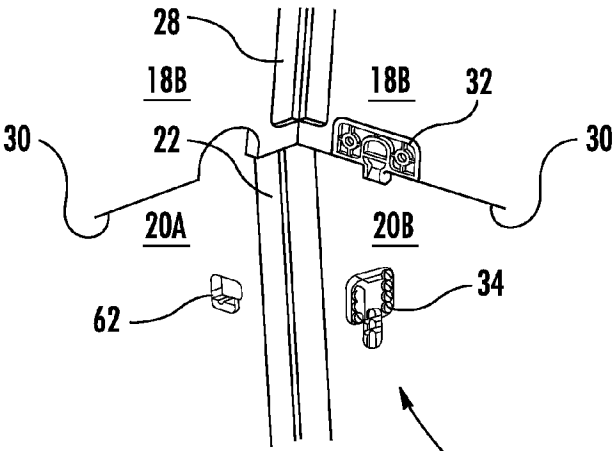
FIG. 6 is a close up view of the latch from dashed circle shown in FIG. 5.

Referring to FIGS. 6 and 7, a barb 32 is fastened to each or two of the end-leg panels 18*b*, which as the folding table 10 are deployed, drive into a catch 34. The catch 34 is captured between the top panel 12*a*, 12*b* and the backing panel 20*a*, 20*b*, and serves to lock the folding table 10 in the deployed state.

Referring to FIGS. 8*a*, 8*b*, 9*a*, and 9*b*, the barb 32 has a base member 36 that is configured and arranged to be secured to the end-leg panel 18*b*. A projection 38 extends upwardly from the base 36 and has a pair of opposing raised shoulders 40 near the top end of the projection 38 that extend laterally from the projection 38. The projection 38 also has an engaging face 42 with a recess 44 formed thereon, which cooperates with the catch 34 to secure the folding table 10 in the deployed state. The barb 32 is preferably molded from plastic, although other materials may be used with equal effectiveness.

Referring to FIGS. 10*a*, 10*b*, 11*a*, 11*b*, and 12, the catch 34 includes two spaced-apart opposing guides 46 that have a raised surfaces 48 thereon augmented by a pair of raised shoulders 50 at one end. Offset ninety degrees from the guides are a stop portion 52 and an opposing a lock portion 54. Together, the stop portion 52, guides 46, and lock portion 54 define a first region 56 configured to receive the projection 38 of the barb 32. The lock portion 54 has a locking projection 58 extending therefrom that is configured to cooperate with the recess 44 on the engaging face 42 of the projection 38 of the barb 32. The lock portion 54 is positioned at the side of the guides 46 that includes the raised shoulders 50. The raised shoulders 50 of the guides 46 and the locking projection 58 of the lock portion 54 define a second region 60 to releasably capture the projection 38 of the barb 32.

The guides 46 cooperate with the barb 32 to releasably lock the barb 32 to the catch 34. In particular, the projection 38 on the barb 32 fits between the guides 46 such that the raised shoulders 40 on the projection 38 of the barb 32 lock with the raised surfaces 48 on the guides 46. As the folding table 10 is reconfigured to the deployed state, the projection 38 of the barb 32 slides within the first region 56 of the catch 34, over the raised shoulders 50 of the guides 46, and into the second region 60 where the recess 44 on the engaging face 42 of the barb 32 becomes seated on the locking projection 58 of the lock portion 54 of the catch 34. As can be appreciated, the barb 32 becomes temporarily secured to the catch 34 until the folding table 10 is reconfigured to the folded state as shown in FIG. 7. To stow the folding table 10, the barbs 32 are uncoupled from the catches 34 by following the above sequence in reverse.

Figure 13:
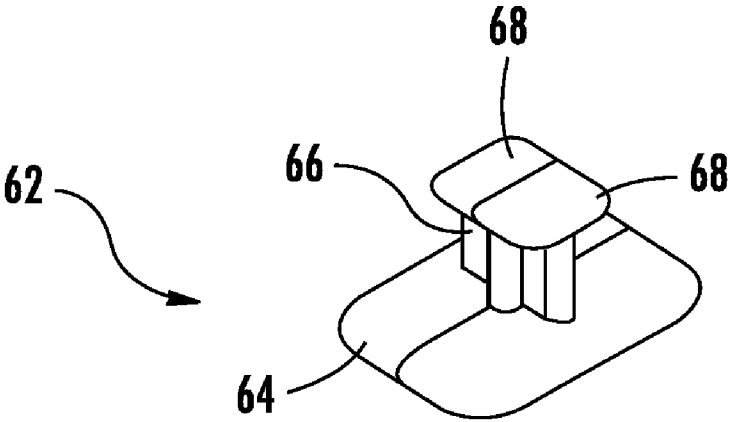
FIG. 13 is a perspective view of the latch used to keep the folding table in its folded state.
Figure 15:
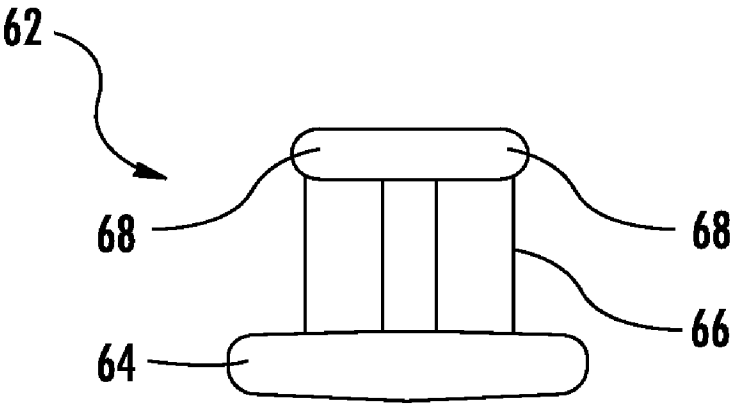
FIG. 15 is a front plan view of the latch shown in FIG. 13.
Figure 14:
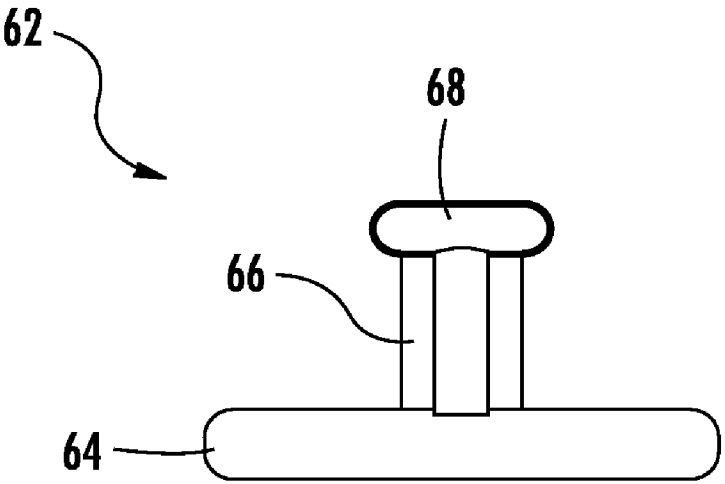
FIG. 14 is a side plan view of latch shown in FIG. 13.

Referring to FIGS. 13-15, to keep the folding table 10 from accidentally deploying while in the folded state, a pair of latches 62 is configured to cooperate with each of the catches 34, respectively, to releasably secure the folding table 10 in the folded state. In particular, each latch 62 includes a base portion 64 and a projection 66 extending therefrom. The projection 66 has a pair of raised shoulders 68 extending laterally from the top end of each projection 66. The projections 66 of the latch 62 are configured to insert into the first region 56 of the catch 34. The raised shoulders 68 on the projection 66 of the latch 62 cooperate with the raised edges 48 on the guides 46 to secure the latch 62 and catch 34 together. The latches 62 release from the catches 34 by applying sufficient outward pressure, such as when deploying the folding table 10, to overcome the resiliency of the guides 46.

A hook-and-loop type fastener (not shown), strap or the like may also be employed to secure the folding table 10 in its folded state.

The folding table 10 can include optional spaced-apart cut-outs 70 in the top panels 12*a*, 12*b* and backing panels 20*a*, 20*b* to provide a handle or to serve as a point to hang the folding table 10 when storing the folding table 10.

Therefore, it can be seen that the present invention provides a unique solution to the problem of providing a folding table that presents a light weight and small form factor that is easily operated, yet is stable and stylish too.

It would be appreciated by those skilled in the art that various changes and modifications can be made to the illustrated embodiments without departing from the spirit of the present invention. All such modifications and changes are intended to be within the scope of the present invention except as limited by the appended claims.

I claim:

1. A folding table, comprising:

two top panels hingedly connected together to form a table top having a top surface and a bottom surface, said table top having a folding action about the hinged connection of the two top panels;

a first pair of legs depending from the bottom surface of the table top, each of the legs in said first pair of legs having a first section and a second section, the first section having a top edge hingedly connected to the bottom surface of the table top and a side edge hingedly connected to the second section, the second section of each leg in said first pair of legs being hingedly connected to the other, the hinged action of the two interconnected second sections folding outwardly and traveling in a plane of symmetry with the folding action of the table top;

a second pair of legs depending from the bottom surface of the table top, each of the legs in said second pair of legs having a first section and a second section, the first section having a top edge hingedly connected to the bottom surface of the table top and a side edge hingedly connected to the second section, the second section of each leg in said second pair of legs being hingedly connected to the other, the hinged action of the two interconnected second sections folding outwardly and traveling in a plane of symmetry with the folding action of the table top;

at least one barb extending from each of said second sections of said first leg and said second leg of said first pair of legs and said second pair of legs, said at least one barb having a base portion and a projection extending therefrom, said projection having a pair of opposed raised shoulders extending laterally therefrom and an engaging face with a recess formed thereon; and at least one catch on each of said top panels configured and arranged to selectively latch with said at least one barb to lock said top panels to said second sections of said first leg and said second leg of said first pair of legs and said second pair of legs in a deployed state, said at least one catch having a pair of inwardly facing guides to receive the shoulders of the projections of the barb and a locking portion configured and arranged to receive the projection of the barb and cooperate with the recess on the barb to selectively lock the barb to the catch;

whereby the folding table may be collapsed from a deployed state forming a table to a folded state for storage and portability.

2. The folding table of claim 1, further comprising:

a first cut-out on one of the top panels;

a second cut-out on the other of the top panels;

said first cut-out and said second cut-out being symmetrical and complimentary; and whereby said first cut-out and said second cut-out form a unitary handle when the folding table is in the folded state.

3. The folding table of claim 1, further comprising:

at least one latch on each of said top panels; and said at least one catch on each of said top panels is further configured and arranged to selectively latch with said at least one latch of the other of said top panels to selectively lock said top panels together in the folded state.

4. The folding table of claim 3, wherein said at least one latch has a base portion and a projection, said projection having a pair of opposed raised shoulders extending laterally therefrom, and said inwardly facing guides of said at least one catch are further configured and arranged to receive said projection and cooperate with said raised shoulders to selectively lock said top panels together in the folded state.

5. The folding table of claim 1, wherein each top panel further includes a back panel secured to the bottom surface of the table top.

* * * * *